US008208232B2

(12) United States Patent
Almalki et al.

(10) Patent No.: US 8,208,232 B2
(45) Date of Patent: Jun. 26, 2012

(54) AUTOMATED ANTI-EXPLOSION SYSTEM AND METHOD FOR INTEGRATED-DRIVE-GENERATOR

(76) Inventors: Fahad H. Almalki, Riyadh (SA); Saeed H. Almalki, Riyadh (SA)

( * ) Notice: Subject to any disclaimer, the term of this patent is extended or adjusted under 35 U.S.C. 154(b) by 205 days.

(21) Appl. No.: 12/269,680

(22) Filed: Nov. 12, 2008

(65) Prior Publication Data

US 2009/0116155 A1 May 7, 2009

(30) Foreign Application Priority Data

Mar. 3, 2007 (GC) ..... 7867/2007
Feb. 24, 2008 (WO) ..... PCT/IB2008/000400

(51) Int. Cl.
*H02H 7/06* (2006.01)

(52) U.S. Cl. ..... 361/20

(58) Field of Classification Search ..... 361/20
See application file for complete search history.

(56) References Cited

U.S. PATENT DOCUMENTS 4,912,382 A * 3/1990 Koenig et al. ..... 318/563
7,506,724 B2 * 3/2009 Delaloye ..... 184/6.2
2003/0048203 A1 * 3/2003 Clary et al. ..... 340/945

* cited by examiner

*Primary Examiner* — Dharti Patel
(74) *Attorney, Agent, or Firm* — Dunlap Codding, P.C.

(57) ABSTRACT

A system for automatically cutting off the energy from, and shutting down an electric generator positioned inside an aircraft engine and supplying electrical power to the aircraft. The system comprising an electric generator, a control panel and driving cabin. The generator having a sensor positioned inside the generator sensing the oil pressure and outputting a signal in response to the oil pressure reaching a predetermined level; a generator disconnect solenoid; and an automatic generator connector receiving the output of the sensor, and in response removing the electrical power supplied by the generator to the aircraft and outputting a signal to the generator disconnect solenoid causing the generator to shut down, and also outputting a control signal. A control panel receiving the control signal and in response outputting a driving cabin control signal. A driving cabin control system receiving the driving cabin control signal and activating a warning system in response.

16 Claims, 3 Drawing Sheets

AUTOMATED ANTI-EXPLOSION SYSTEM AND METHOD FOR INTEGRATED-DRIVE-GENERATOR

CROSS-REFERENCE TO RELATED APPLICATIONS

This application claims the benefit of International Application Number PCT/IB2008/000400, filed Feb. 24, 2008, which claims the benefit of GCC application number 7867/2007, filed Mar. 3, 2007, both of which are incorporated herein by reference in their entirety.

FIELD OF THE INVENTION

The present invention relates to safety means in plane engines especially concerning stopping the operating of electric energy generator in it automatically when the temperature of the generator is high or when the oil pressure is high.

BACKGROUND OF THE INVENTION

In plane engines there are electric energy generators which are responsible for providing the plane with electric energy and these generators use the kinetic energy of the engine for this purpose. And these electric generators need oil which require the presence of oil filter in every energy generator and the oil filter purifies the used oil in the generator and clears it from impurities as the piling impurities as known during the operating of the generator block the oil filter which results in high pressure/or temperature inside the generator.

In the previous technology a lamp is lighted upon high temperature in the control panel inside the driving cabin to alarm the pilot or the flying engineer of the high temperature which requires manually stopping the generator by the pilot or the flying engineer. High temperature may be due to any defect occurring in the engine. Since noticing such lamp is not easy in a control panel full of keys and lights the manufacturers isolated the generator inside a chamber in the engine from the whole engine due to what the high temperature, and what may accompany it like high oil pressure may cause in the engine like an explosion during flying. The explosion of the generator may exceed the chamber assigned for the explosion to effect other parts in the engine which may cause harms in fueling means in the plane and fuel leakage. Consequently it may cause a fire in the engine and also cause disasters for planes.

Since the generator converts the kinetic energy supplied from the engine into electric energy used for providing the plane with electric energy, the speed of rotation of the engine, which varies from time to time during flying, may generate an unstable current, there is a control device which controls the speed of rotation of the electronic energy generators which is responsible for stability of the resulting electric energy from the generator. Whatever the speed of the engine is when the generator speed stabilizer is turned off the generator is completely off. To express easily during the description of the invention we shall use a phrase like "turn off the generator" which include turning off. The electric generator speed stabilizer and consequently turning off the generator itself to stop working.

SUMMARY OF THE INVENTION

The present invention relates to the problem of forgetting the manual turning off for the electric energy generator inside the engine when the temperature or the pressure is high as a result of the blockage of the oil filter or any other defect and that is done through the automatic turning off for the generator. In the previous technology when the temperature is high or when the oil pressure is high inside the engine as a result of the oil filter blockage or any other defect in the engine, a column (a pointer) connected to the filter appears from its position (in the engine and not in the driving cabin) as a sign for the maintenance engineer to indicate that the filter is blocked and needs to be changed during the maintenance and at the same time an independent electric circuit illuminates a warning lamp in the control panel inside the driving cabin alarming with the high temperature so that the flight engineer or the pilot can turn off the generator manually with the key assigned for turning it off or on.

In the present invention the electric generator is turned off automatically when its temperature is high or when the oil pressure inside it is high without the need of human interference and that is done in either of the two following ways: 1—when the oil pressure inside the generator is high, and that is done when the sensor constructed on the column (pointer) of the filter blockage closes the electric circuit and consequently turns off the defective generator automatically which causes it to stop working and thus prevent an explosion and causing harms. The electric circuit illuminates a lamp in the control panel to alarm the pilot or flight engineer of the high oil pressure. At the same time a sound alert is released inside the driving cabin which can be cut off manually to prevent disturbance during flying.

2—when the temperature of the generator is higher than the allowed limit, a sensor for high temperature (known from the previous technology) closes the electric circuit and consequently cuts off the energy of the defective generator automatically (and it is one of the new things in this invention) which causes it to stop working and consequently prevents an explosion and causing harms. The electric circuit which is connected to the temperature sensor also works to illuminate the high temperature lamp in the driving cabin (known from the previous technology) and releases a sound alert inside the driving cabin which may be cut off manually for preventing disturbance (and it is one of the new things in this invention) and in all cases the system was provided with a manual key to cut off the energy from the generator manually in case a defect occurs in the circuit of the automatic turning off for the generator.

In an embodiment of the present invention, disclosed is a device for automatically cutting off the energy from an electric generator or from an integrated drive generator to shut it down, the generator is located inside a plane engine and consists of three main parts. The first part is located in the electric generator of the engine and it contains two sensors plus an automatic generator connector. The first sensor operates once the oil pressure of the electric generator is high, the second sensor operates once the temperature of the electric generator is higher than the allowed temperature, and the automatic generator connector sends electric signal to a generator circuit contactor to remove the load from the electric power. Thereafter it sends an electric signal to the generator disconnect solenoid which is located inside the generator to stop the generator from working and to shut it down.

The second part is located in the driving cabin, and it contains indicators and switches. The indicators are to show the operator the status of the electric generator such as its automatic cutting off of the operation, while the switches are for manual control and testing.

The third part is located at any place in the plane and contains a control panel which connects the first two parts. Wherein the first sensor works when the generator oil pressure is high by sending an electric signal to the automatic generator connectors to cut off the generator automatically and the second sensor works by sending an electric signal to the automatic generator connectors to cut off the generator automatically when the temperature of the generator is higher than the allowed limit.

Another aspect of the embodiment is where the indicators of the generator, stated in the second part of the device, are represented in a first lamp that illuminates permanently in case the generator works and is cut off automatically in case of its automatic cutting off.

Another aspect of the embodiment is where one of the cutting off indicators, stated in the second part of the device, is represented in a second lamp illuminated automatically upon the automatic cutting off of the generator. The second lamp is connected to the said first sensor for high oil pressure inside the generator.

Another aspect of the embodiment is where one of the generator cutting off indicators stated in the second part of the device, is represented in a third lamp illuminated automatically upon the automatic cutting off of the generator. The third lamp is connected to the said second sensor concerned with higher temperature of the generator than the allowed limit.

Another aspect of the embodiment is where one of the generator cutting off indicators, stated in the second part of the device represented in a sound alarm releasing automatically a loud sound upon the automatic cutting off of the generator. The sound alarm is connected to both the said first and second sensor.

Another aspect of the embodiment is where the second of sound alarm can be cut off which is released automatically upon the automatic cutting off of the generator with a manual cutting off key and which cutting off the sound alarm does not affect any one of the other cutting off or operating which are described.

Another aspect of the embodiment is where the generator can be cut off manually with a key intended for that.

Another aspect of the embodiment is where the system is provided with a test key for testing operation of the circuit after the replacement of the oil strainer or repairing the generator defect in which the said key works to operate the entire system and what is connected to it such that lamps or a sound alarm to make sure the correctness of the wiring of the circuit and end of the defect.

Another aspect of the embodiment is where the indicators of operating the generators and represented by the second lamp or third lamp is lighted upon cutting off of the generator until the defect is repaired in the generator and getting the device ready for work with the said test key, that the first lamp is illuminated again and the second and the third are off again as a sign of correctness of the wiring and repairing the defect in the generator.

In another embodiment of the present invention, what is disclosed is a method for automatically cutting off electric power energy and shutting down a generator or integrated drive generator safely inside a plane engine, the method consists of three main stages. In the first stage, the first sensor is alerted once the oil pressure of the generator is high, the second sensor is alerted once the temperature of the generator is higher than the allowed limit, and the automatic generator connector stops the electric generator by cutting off the electric power energy from the generator contactor and sends electric signal to the generator disconnect solenoid to be shut down.

The second stage takes place in the driving cabin through indicators showing the status of the electric generator such as its automatic cutting off to the operation, and thereafter the operator may use switches therein for manual control and testing.

The third stage takes place anywhere inside the plane through an electronic control panel which connects the first and second stages as the first sensor starts sending an electric signal to the generator contactor to remove the electric load and to cut off the generator automatically once the oil pressure is high. While the second sensor sends electric signal to the automatic generator disconnect solenoid connectors to cut off the generator automatically once the temperature of the generator is higher than the allowed limit.

DETAILED DESCRIPTION OF THE INVENTION

Figure 1:
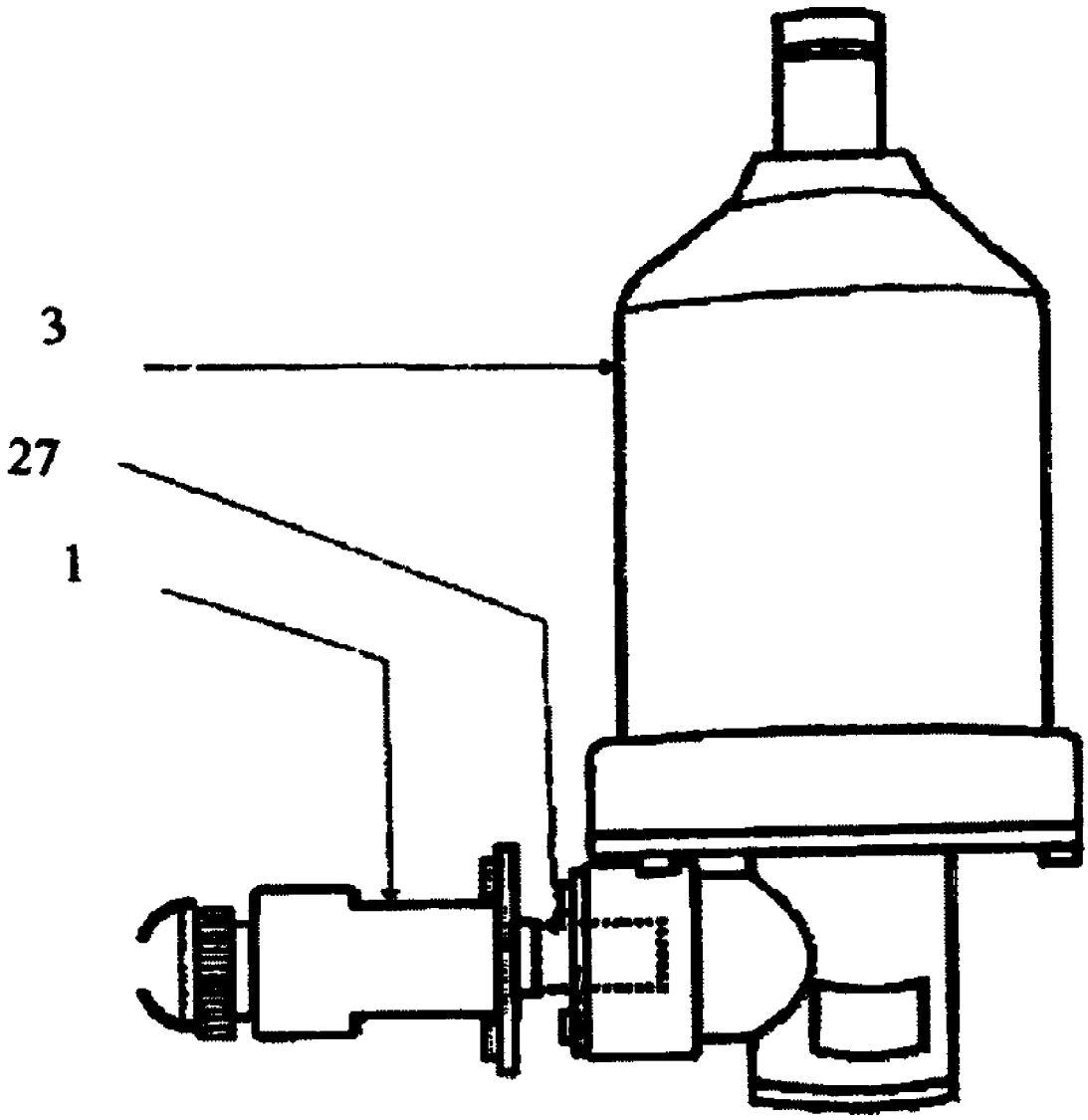
FIG. 1 is a side view for the oil strainer (filter) which is connected to the electric energy generator inside a plane engine. It is connected to an operating sensor for the described circuit in this invention.
Figures 2, 3:
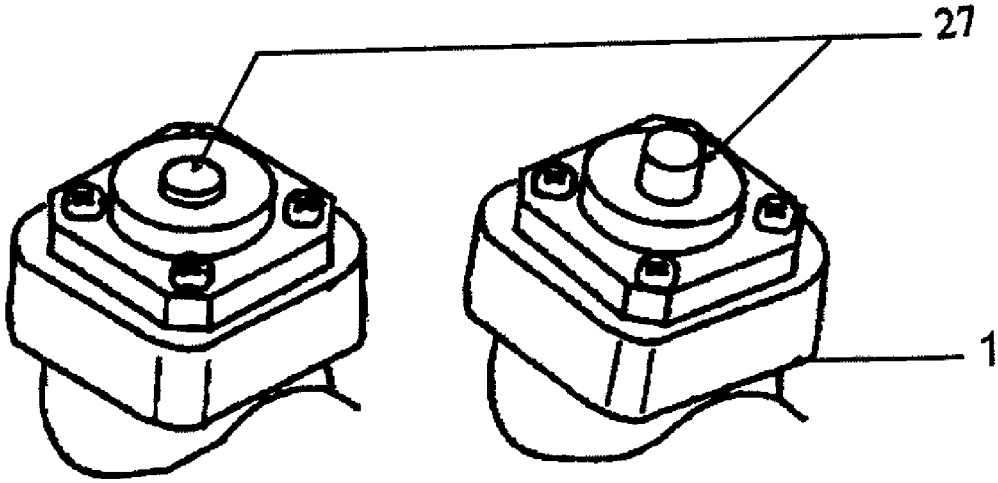
FIG. 2 is a detailed view of a high pressure sensor which is connected to the oil strainer to indicate the normal pressure of the generator.
FIG. 3 is a detailed view of the high pressure sensor which is connected to the oil strainer to indicate the blockage of the strainer.

FIG. 1 shows the oil strainer 1 of the electric energy generator in a plane engine where a sensor of the high pressure 3 for operating the electric circuit which aims at stopping the operation of the generator when the oil pressure is high inside the generator as a result of the blockage of the oil strainer with impurities. From the previous technology the oil strainer contains a pointer for high oil pressure 27 of FIGS. 2 and 3 which has the form of a column which emerges from its position in the strainer 1, as in FIG. 3, to indicate the blockage of the strainer 1 with impurities which require its change to avoid the explosion of the generator during the flight so the technician assigned changes the strainer when the pointer 27 emerges from its position.

Figure 4:
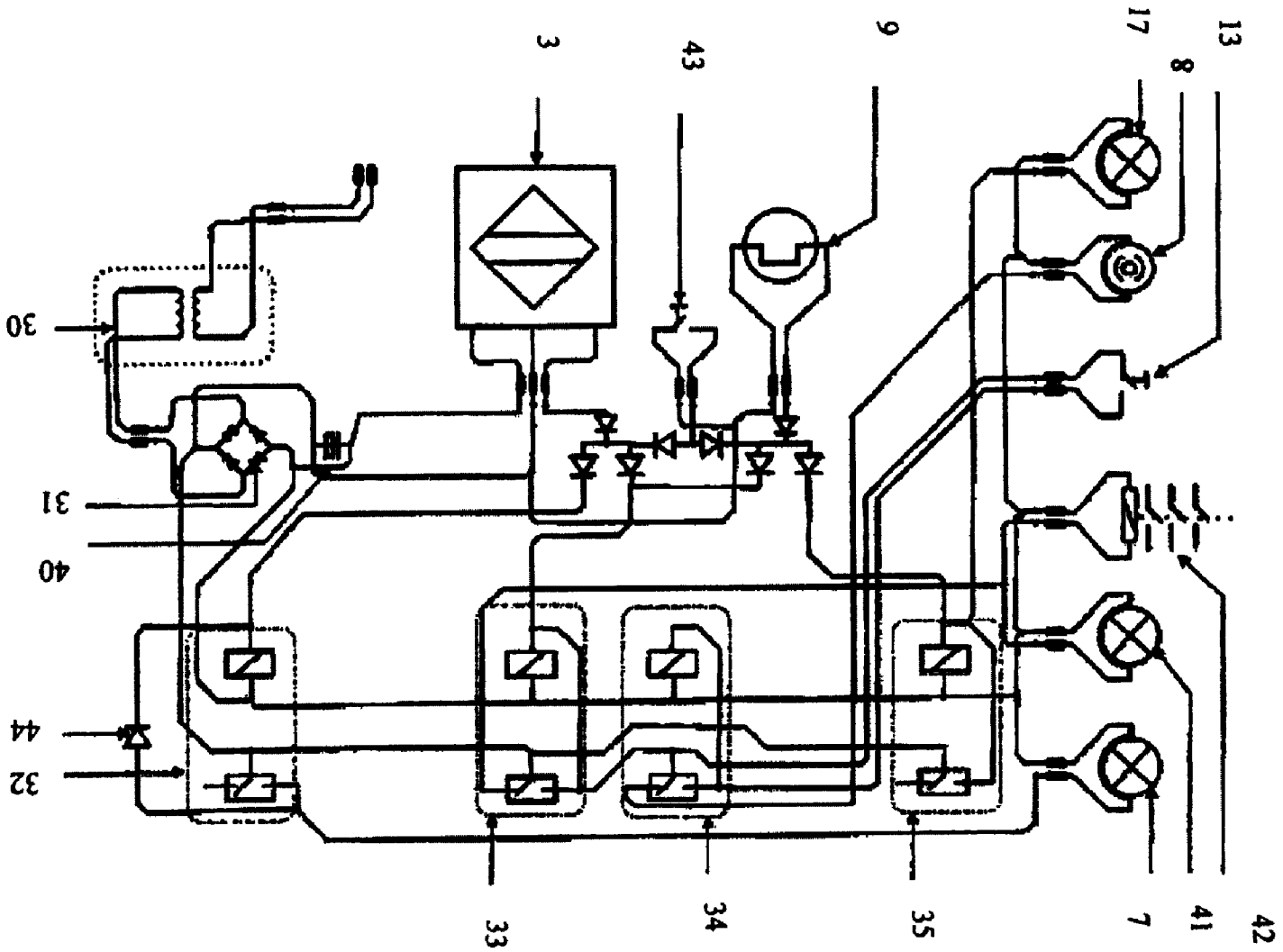
FIG. 4 is a systematic view of the electric circuit of the invention.

In the present invention (FIG. 1) a sensor for high pressure 3 is connected to the oil strainer 1 from the side of the pointer 27 to close the electric circuit as the oil pressure sensor 3 receives the signal from the pointer 27 and then sends an electric signal to start the operating of the electric circuit shown in FIG. 4.

FIG. 4 shows the operating process of the electric circuit for protecting the generators from explosion as it is supplied with alternating current (AC) with a potential difference of 110 or 220 volts. An electric current flows to the transformer 30 (converter) to convert the potential difference into the suitable potential difference for use in the plane (about 28 Vo Hz), then across rectifier bridge 31 to convert it from AC into DC, then to the capacitor 40, then to the oil pressure sensor 3 (proximity sensor) and the high temperature sensor 9 as it waits for one of two signals to start operating the electric circuit.

The first signal: emerging from the high oil pressure column from its position as a result of the strainer 1 blockage with impurities or any other reason so the pressure sensor 3 receives the signal so the electric circuit starts operating as the following happens at the same time:

1—A signal is sent to generator connector 42 to stop operating the generator and separate it from the electric system.

2—The warning lamp illuminates with high oil pressure in the strainer 1 across relay 32.

3—A sound is released from the alarm & across the relay 33 which may be cut off with the alarm sound cutting off key 13 connected to relay 34 to prevent disturbance. The relay 34 aims at cutting off the sound from the operating system of the electric circuit without changing the other components of the electric circuit.

4—Breaking down of the system lamp 41 which works in case the system works normally and is cut off when the high oil pressure lamp 7 is illuminated or high temperature lamp 17 is illuminated.

5—Operating the rectifier 44 which aims at keeping the relay 32 in the operating position (i.e. keeping the oil pressure lamp 7 in the operating position) until the strainer 1 is replaced or the generator defect is repaired.

The second signal: if the generator temperature is high then the temperature sensor 9 sends an electric signal 9 so the electric circuit starts operating as the following happens at the same time:

1. A signal is sent to generator connector 42 to stop the operating of the generator and separate it from the electric system.
2. Illuminating the warning lamp 17 with high temperature of the generator across relay 35.
3. A sound is released from the alarm 8 across relay 33 which can be cut off with alarm sound cutting off key 13 connected to relay 34 to prevent disturbance. Relay 34 aims at cutting off the sound from the electric circuit system without changing any other components of the electric circuit.
4. Breaking down the system lamp 44 which works in case the system operates normally and is cut off when the high oil pressure lamp 7 is illuminated/or high temperature 17.
5. Operating the rectifier 44 which aims at keeping relay 32 in the operating position (i.e. keeping the temperature lamp 17 in the operating position) until the strainer 1 is replaced or the generator defect is repaired.

The electric circuit is provided with a test key 43 which aims at testing the complete electric circuit to make sure that it works properly, that is after the replacement of the oil strainer or the repairing of the generator defect.

The high oil pressure lamp 7, the high temperature lamp 17, the system lamp 41, the alarm 8, the alarm sound cutting off key 13 and the test key of the electric circuit are located in the driving cabin while high pressure sensor 3 and high temperature sensor 9 are located in the electric energy generator and the shown electric circuit (FIG. 4) is located at any suitable place in the plane.

The manual cutting off key has been kept which is known in the previous technology for operating the generator among the electric circuit (not shown in the drawings) and that for cutting off the energy from the generator in case of any defect in generator connector 42.

The said features for the invention work toward safety during air flights and reducing the maintenance cost resulting from a generator explosion inside the engine and what follows that like requiring spare parts and delays in the air flights schedules. Also, the device may be used for doing tests on the electric generators in test chambers.

Referring to the above description what is worth stating is that the optimum degree for the relation between the measurements of the parts of the invention is considered obvious to specialists in this field so any modifying in the size of the manufacturing materials, the shape, the form, the construction process, the operating process or the using process is regarded obvious for the specialists in this field and every similar process to what has been shown in the drawings is understood to be inside the scope of this invention.

What is claimed is:

1. A system for automatically cutting off the energy from, and shutting down an electric generator positioned inside an aircraft engine and supplying electrical power to an aircraft, the system comprising:

an electric generator positioned inside an aircraft engine, the generator utilizing an oil system having an oil pressure, the generator further comprising;

a sensor positioned inside the generator, the sensor sensing the oil pressure and outputting a signal in response to the oil pressure reaching a predetermined level;

a generator disconnect solenoid adapted to shut down the generator; and an automatic generator connector receiving the output of the sensor, and in response removing the electrical power supplied by the generator to the aircraft and further outputting a signal to the generator disconnect solenoid causing the generator to shut down, wherein the automatic generator connector further outputs a control signal;

a control panel positioned in the aircraft, the control panel receiving the control signal from the automatic generator connector and in response outputting a driving cabin control signal; and a driving cabin control system located in the driving cabin of the aircraft, the control system receiving the driving cabin control signal from the control panel and activating a warning system in response.

2. The system according to claim 1, wherein the warning system of the driving cabin control system comprises a warning light, and wherein the light illuminates automatically in response to receiving the driving cabin control signal from the control panel.

3. The system according to claim 1, wherein the warning system of the driving cabin control system comprises an audible alarm and an alarm cut-off key, and wherein the alarm activates automatically in response to receiving the driving cabin control signal from the control panel.

4. The system according to claim 3, wherein the alarm cut-off key operates to de-activate the alarm without affecting the automatic cutting off the energy from, and shutting down the electric generator.

5. The system according to claim 1, wherein the driving cabin control system further comprises a generator shut-off key which operates to shut down the electric generator.

6. The system according to claim 1, wherein the driving cabin control system further comprises a test key, the test key operating to test the aircraft electrical system being supplied power from the generator when the stimulus causing the oil pressure to reach the predetermined level has been removed.

7. The system according to claim 1, wherein the electric generator further comprises a temperature sensor positioned inside the generator, the sensor sensing the temperature of the generator and outputting a temperature signal in response to the temperature reaching a predetermined level, wherein the automatic generator connector receives the output of the temperature sensor, and in response removes the electrical power supplied by the generator to the aircraft and further outputs a signal to the generator disconnect solenoid causing the generator to shut down, and further wherein the automatic generator connector further outputs the control signal in response to receiving the temperature signal.

8. A system for automatically cutting off the energy from, and shutting down an electric generator positioned inside an aircraft engine and supplying electrical power to an aircraft, the system comprising:

an electric generator positioned inside an aircraft engine, the generator further comprising;

a sensor positioned inside the generator, the sensor sensing the temperature of the generator and outputting a signal in response to the temperature reaching a predetermined level;

a generator disconnect solenoid adapted to shut down the generator; and an automatic generator connector receiving the output of the sensor, and in response removing the electrical power supplied by the generator to the aircraft and further outputting a signal to the generator disconnect solenoid causing the generator to shut down, wherein the automatic generator connector further outputs a control signal;

a control panel positioned in the aircraft, the control panel receiving the control signal from the automatic generator connector and in response outputting a driving cabin control signal; and a driving cabin control system located in the driving cabin of the aircraft, the control system receiving the driving cabin control signal from the control panel and activating a warning system in response.

9. The system according to claim 8, wherein the warning system of the driving cabin control system comprises a warning light, and wherein the light illuminates automatically in response to receiving the driving cabin control signal from the control panel.

10. The system according to claim 8, wherein the warning system of the driving cabin control system comprises an audible alarm and an alarm cut-off key, and wherein the alarm activates automatically in response to receiving the driving cabin control signal from the control panel.

11. The system according to claim 10, wherein the alarm cut-off key operates to de-activate the alarm without affecting the automatic cutting off the energy from, and shutting down the electric generator.

12. The system according to claim 8, wherein the driving cabin control system further comprises a generator shut-off key which operates to shut down the electric generator.

13. The system according to claim 8, wherein the driving cabin control system further comprises a test key, the test key operating to test the aircraft electrical system being supplied power from the generator when the stimulus causing the temperature to reach the predetermined level has been removed.

14. The system according to claim 8, wherein the electric generator further comprises an oil system having an oil pressure and an oil pressure sensor positioned inside the generator, the oil pressure sensor sensing the oil pressure of the generator and outputting an oil pressure signal in response to the oil pressure reaching a predetermined level, wherein the automatic generator connector receives the output of the oil pressure sensor, and in response removes the electrical power supplied by the generator to the aircraft and further outputs a signal to the generator disconnect solenoid causing the generator to shut down, and further wherein the automatic generator connector further outputs the control signal in response to receiving the oil pressure signal.

15. A method for automatically cutting off the energy from, and shutting down an electric generator positioned inside an aircraft engine and supplying electrical power to an aircraft, the electric generator utilizing an oil system having an oil pressure, the method comprising the steps of:

sensing, by a sensor positioned inside the generator, the oil pressure;

outputting, by the sensor, a high pressure signal in response to the oil pressure reaching a predetermined level;

receiving, by an automatic generator connector, the high pressure signal from the sensor, and in response disconnecting the electric power being supplied from the generator to the aircraft;

outputting, by the automatic generator connector, a solenoid control signal to a generator disconnect solenoid operating to shut down the electric generator;

outputting, by the automatic generator connector, a control panel signal;

receiving, by a control panel, the control panel signal and outputting a driving cabin control signal in response;

receiving, by a driving cabin control system, the driving cabin control signal and activating a warning system in response.

16. A method for automatically cutting off the energy from, and shutting down an electric generator positioned inside an aircraft engine and supplying electrical power to an aircraft, the method comprising the steps of:

sensing, by a sensor positioned inside the electric generator, the temperature of the electric generator;

outputting, by the sensor, a temperature signal in response to the temperature reaching a predetermined level;

receiving, by an automatic generator connector, the temperature signal from the sensor, and in response disconnecting the electric power being supplied from the generator to the aircraft;

outputting, by the automatic generator connector, a solenoid control signal to a generator disconnect solenoid operating to shut down the electric generator;

outputting, by the automatic generator connector, a control panel signal;

receiving, by a control panel, the control panel signal and outputting a driving cabin control signal in response;

receiving, by a driving cabin control system, the driving cabin control signal and activating a warning system in response.

* * * * *